US010190445B2

(12) United States Patent
Mohan Das et al.

(10) Patent No.: US 10,190,445 B2
(45) Date of Patent: Jan. 29, 2019

(54) SWITCHABLE ROLLER FINGER FOLLOWER WITH INTEGRATED LEAKAGE PATH FOR DE-AERATION

(71) Applicant: Schaeffler Technologies AG & Co. KG, Herzogenaurach (DE)

(72) Inventors: Pradeep Mohan Mohan Das, Troy, MI (US); Faheem Ahmed, Troy, MI (US); David Chandler, Windsor (CA)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 187 days.

(21) Appl. No.: 15/282,602

(22) Filed: Sep. 30, 2016

(65) Prior Publication Data

US 2018/0094551 A1 Apr. 5, 2018

(51) Int. Cl.

| | |
|---|---|
| ***F01L 1/24*** | (2006.01) |
| ***F01L 13/00*** | (2006.01) |
| ***F01L 1/18*** | (2006.01) |

(52) U.S. Cl.

CPC ..... *F01L 1/24* (2013.01); *F01L 1/185* (2013.01); *F01L 13/0005* (2013.01); *F01L 13/0021* (2013.01); *F01L 1/2405* (2013.01); *F01L 13/0036* (2013.01); *F01L 2001/186* (2013.01); *F01L 2001/2444* (2013.01); *F01L 2013/001* (2013.01); *F01L 2105/00* (2013.01); *F01L 2820/01* (2013.01); *F01L 2820/033* (2013.01)

(58) Field of Classification Search

CPC . F01L 1/24; F01L 13/0021; F01L 2001/2444; F01L 13/0005; F01L 1/185; F01L 2001/186; F01L 2820/033; F01L 13/0036; F01L 2105/00; F01L 2013/001; F01L 2820/01; F01L 1/2405

USPC ..... 123/90.16

See application file for complete search history.

(56) References Cited

U.S. PATENT DOCUMENTS

| | | | | |
|---|---|---|---|---|
| 7,174,869 | B2 | 2/2007 | Proschko et al. | |
| 7,909,007 | B2 | 3/2011 | Manther et al. | |
| 9,790,820 | B2 * | 10/2017 | Evans | F01L 1/245 |
| 2006/0016496 | A1 * | 1/2006 | Shane | E03C 1/086 137/801 |
| 2007/0166174 | A1 * | 7/2007 | Marriott | F04B 1/0448 417/310 |
| 2015/0267574 | A1 * | 9/2015 | Radulescu | F01L 13/0021 123/90.16 |
| 2016/0102585 | A1 | 4/2016 | Evans | |
| 2018/0058276 | A1 * | 3/2018 | Radulescu | F01L 1/185 |

* cited by examiner

*Primary Examiner* — Jason Newton
(74) *Attorney, Agent, or Firm* — Volpe and Koenig, P.C.

(57) ABSTRACT

A switchable roller finger follower includes an inner lever, an outer lever pivotably mounted to the inner lever by a pivot axle, and a coupling device. The coupling device includes a coupling pin configured to move between a locked position in which the inner lever and the outer lever are connected together for movement in at least one direction and an unlocked position in which the inner lever is movable relative to the outer lever in the at least one direction. The coupling device also includes a spring configured to bias the coupling pin in the locked or unlocked position. A de-aeration flow path is formed between an oil passage and an opening for allowing air to move out of the oil passage, past the coupling pin, and exit through the opening. The de-aeration flow path switches between being open and closed based on a position of the coupling pin.

20 Claims, 6 Drawing Sheets

SWITCHABLE ROLLER FINGER FOLLOWER WITH INTEGRATED LEAKAGE PATH FOR DE-AERATION

FIELD OF INVENTION

The present invention relates to a switchable roller finger follower, and, more particularly, to a switchable roller finger follower with an integrated leakage path for de-aeration.

BACKGROUND

Switchable roller finger followers have an outer lever pivotably mounted outside an inner lever and a roller rotatably mounted on a transverse axle in a slot in the inner lever. An example of a switchable finger follower is described in U.S. Pat. No. 7,174,869. In this case, the top surface of the outer lever can act as a contact surface for a high lift cam and the top surface of the roller acts as a contact surface for a low lift cam. A coupling element is mounted at one end of the finger follower. When the coupling element is activated, it locks the outer lever to the inner lever and requires the follower to follow the high lift cam and transfer the lift to the valve stem of an associated intake or exhaust valve. When the coupling element is deactivated, the outer lever is free to pivot relative to the inner lever, with the motion being absorbed by a lost-motion spring, and the motion of the low lift cam is transferred by the inner lever to the valve stem. In other known arrangements used for cylinder deactivation, the coupling element maintains the inner and outer levers connected in order to transfer lift from the cam to the valve stem for the associated intake or exhaust valve when a cylinder is active, and the coupling element is released by oil pressure for disengaging the inner lever from the outer lever so that the inner lever travels a lost motion stroke when the cylinder is deactivated so that the associated intake or exhaust valve remains closed.

The coupling element is conventionally activated and deactivated by hydraulic pressure. For example, the switchable finger followers may be activated or deactivated by pressurized hydraulic fluid that is fed through a feed path from a switching oil gallery, through a hydraulic lash adjuster, and to an actuator chamber in the roller finger follower. The rise in hydraulic pressure in the actuator chamber pushes the coupling element to the activated or deactivated position. When the hydraulic pressure is reduced, a biasing element returns the coupling element to the respective deactivated or activated position.

One known problem with using hydraulic pressure in a switchable roller finger follower is that there can be a lag time for actuation of the switching function due to air bubbles in the hydraulic fluid in the switching oil gallery or the switching oil hydraulic fluid path to the coupling element actuator. These air bubbles delay the switching time, which is unsuitable for devices which require a short switching time. This also leads to a lack of consistency and repeatability in the switching time.

The present disclosure is directed to overcoming these and other problems of the prior art, including those associated with air being present in the hydraulic flow path of a switchable roller finger follower.

SUMMARY

In one aspect, the present disclosure is directed to a switchable roller finger follower. The switchable roller finger follower includes an inner lever, an outer lever pivotably mounted to the inner lever by a pivot axle, an end block on one of the inner lever or the outer lever and comprising a bore, an opening into the bore on one side of the bore and an oil passage connected to the bore on another side of the bore, and a coupling device. The coupling device includes a coupling pin configured to move between a locked position in which the inner lever and the outer lever are connected together for movement in at least one direction and an unlocked position in which the inner lever is movable relative to the outer lever in the at least one direction. Pressure from a hydraulic fluid from the oil passage moves the coupling pin into one of the locked or the unlocked positions. The coupling device also includes a spring configured to bias the coupling pin in the other of the locked and unlocked positions. Further, a de-aeration flow path is formed between the oil passage and the opening for allowing air to move out of the oil passage, past the coupling pin, and exit through the opening. The de-aeration flow path is open when the coupling pin is in the locked position and blocked when the coupling pin is in the unlocked position.

In another aspect, the present disclosure is directed to another switchable roller finger follower. The switchable roller finger follower includes an inner lever, an outer lever pivotably mounted to the inner lever by a pivot axle, an end block on one of the inner lever or the outer lever and comprising a bore, an opening into the bore on one side of the bore and an oil passage connected to the bore on another side of the bore, and a coupling device. The coupling device includes a coupling pin configured to move between a locked position in which the inner lever and the outer lever are connected together for movement in at least one direction and an unlocked position in which the inner lever is movable relative to the outer lever in the at least one direction. Pressure from a hydraulic fluid from the oil passage moves the coupling pin into one of the locked or the unlocked positions. The coupling device also includes a spring configured to bias the coupling pin in the other of the locked and unlocked positions, and a spring retainer configured to retain an end of the spring. A de-aeration flow path is formed between the oil passage and the opening for allowing air to move out of the oil passage, past the coupling pin, and exit through the opening. The de-aeration flow path is formed at least in part by a cutout feature formed in the coupling pin and a hole in the spring retainer. Movement of the coupling pin from the locked position to the unlocked position disconnects the de-aeration flow path

BRIEF DESCRIPTION OF THE DRAWING(S)

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENT(S)

Figure 1:
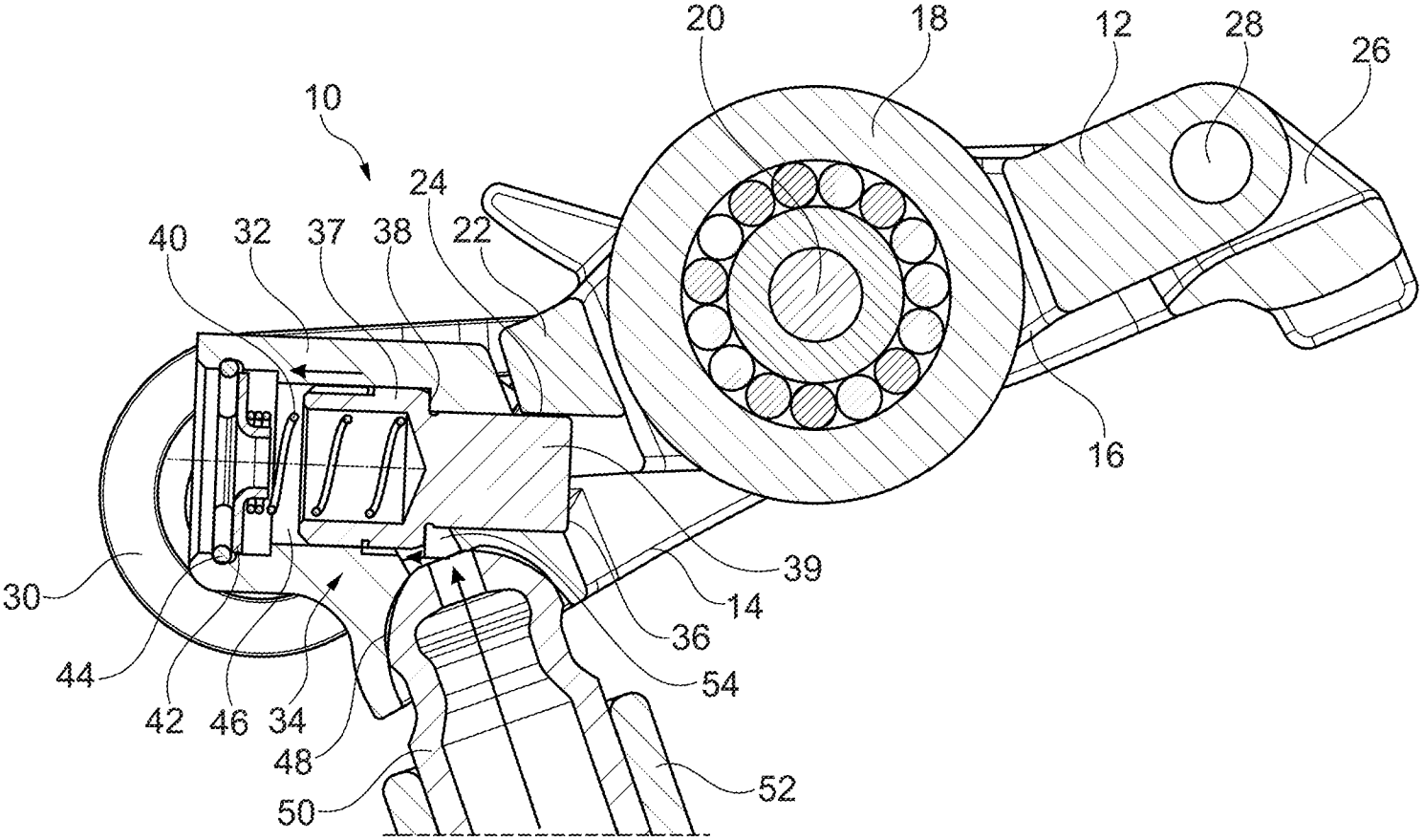
FIG. 1 is cross-sectional view of a switchable roller finger follower, according to a first embodiment.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 2:
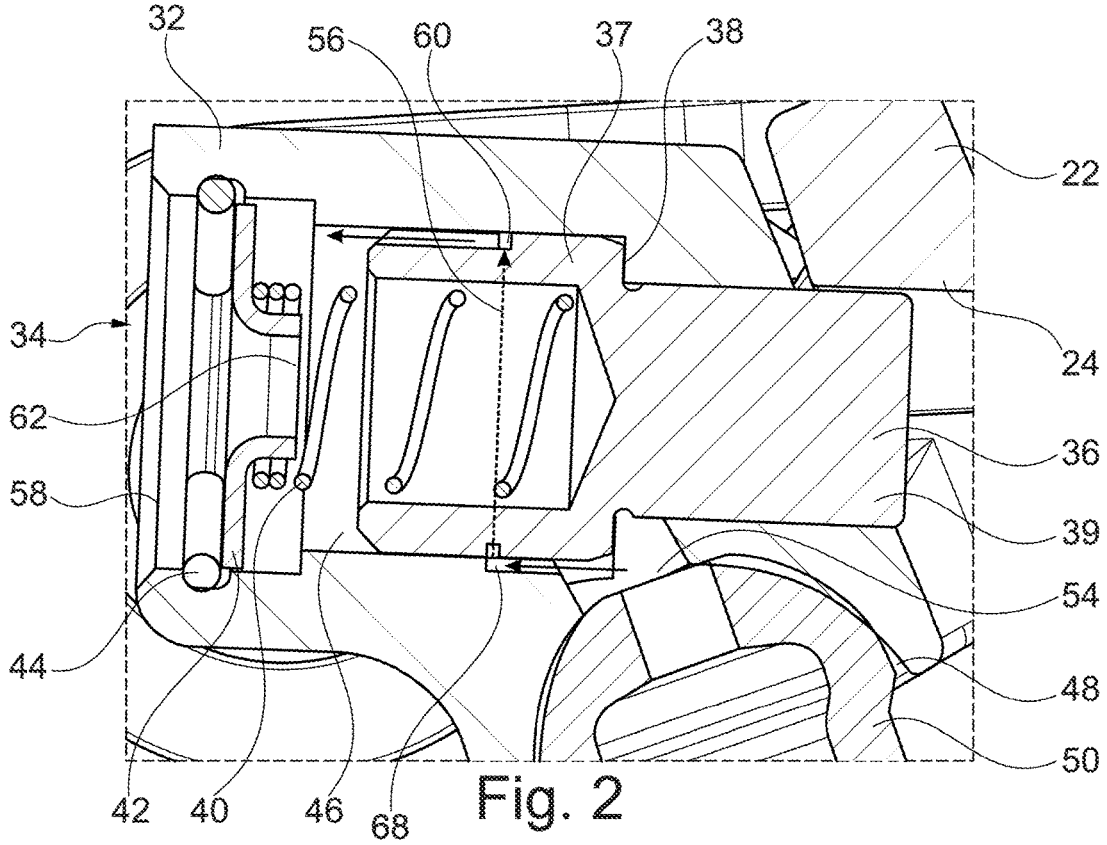
FIG. 2 is an enlarged cross-sectional view of a coupling device of the switchable roller finger follower of FIG. 1 in a locked position.
Figure 3:
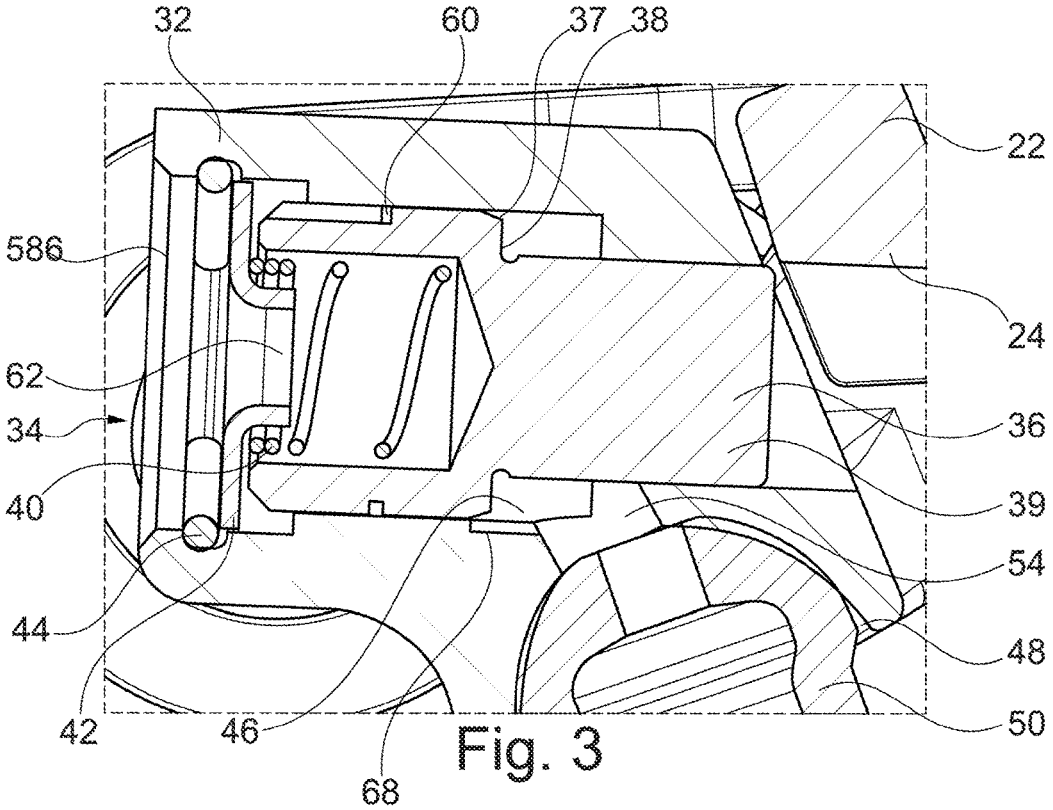
FIG. 3 is an enlarged cross-sectional view of the coupling device of FIG. 2 in an unlocked position.

FIGS. 1-3 illustrate a switchable finger follower 10 according to a first embodiment of the present invention. In an exemplary embodiment, the switchable roller finger follower 10 has at least two lift modes of operation for a valve train of an internal combustion engine (not shown). This can be a lift and no-lift mode, as illustrated, or a high lift and low lift mode. The switchable roller finger follower 10 includes an inner lever 12 and an outer lever 14. A center recess 16 is preferably provided in the inner lever 12 in which a roller 18 is mounted by a transverse axle 20. In alternative embodiments, the inner lever 20 may include a slider pad instead of a roller. A coupling projection 22 is located at a first end of the inner lever 12 and includes a coupling surface 24.

The outer lever 14 includes two outer arms 26 (only one shown) that extend along longitudinal sides of the inner lever 12. The outer lever 14 is mounted for pivoting movement at a second end of the inner lever 20 by a pivot axle 28. The outer lever 14 further includes lost motion springs 30 (only one shown) which preferably engage lost motion spring catches on the outer lever 14 and lost motion spring arms on the inner lever 12. The lost motion springs 30 are configured to bias the inner lever 12 upwardly so the roller 18 is at an upper-most position.

The switchable roller finger follower 10 further includes an end block 32. The end block 32 may be any portion of the outer lever 14 adjacent to the inner lever 12. In other roller finger follow configurations, the end block 32 may be any body portion of the inner lever 12 adjacent to the outer lever 14. The end block 32 may be a separate or integral component of the outer lever 14 or inner lever 12.

FIGS. 1-3 further illustrate a coupling device 34, according to a first disclosed embodiment. In an exemplary embodiment, the coupling device 34 is located in the end block 32 (on one of the outer lever 14 or inner lever 12, dependent on the configuration of the roller finger follower 10). The coupling device 34 includes a coupling pin 36 arranged to move in a longitudinal direction between a locked position (shown in FIGS. 1 and 2), in which the inner lever 12 and the outer lever 14 are connected together for movement at least in an activation direction of a valve, and an unlocked position (shown in FIG. 3), in which the inner lever 12 is pivotable relative to the outer lever 14, for example for a no-lift operating mode used for cylinder deactivation. The coupling pin 36 includes a head portion 37, a shoulder portion 38, and a shaft portion 39.

The coupling device 34 further includes a spring 40 which biases the coupling pin 36 to the locked position. For example, as shown in FIGS. 1 and 2, the pin 36 is forced by the spring 40 to a position in which the shaft portion 39 of the pin 36 engages the coupling surface 24. As a result, the coupling surface 24 of the coupling projection 22 of the inner lever 12 contacts the shaft portion 39 of the coupling pin 36, thereby locking the inner lever 12 to the outer lever 14. In this way, the inner lever 12 and the outer lever are connected together for movement in at least one direction about the transverse axle 20. The spring 40 is held in position via a spring retainer 42 and a lock ring 44 The pin 36, spring 40, spring retainer 42, and snap ring 44 are all located within a stepped bore 46 in the end block 32 of the outer lever 14 (or inner lever 12).

A socket 48 for receiving a support head 50 of a hydraulic lash adjuster 52 is located on the bottom side of the end block 32. An oil passage 54 is formed in the end block 32 and is connected to the socket 48 and leads to the bore 46 in an area of the shoulder portion 38 of the coupling pin 36. Hydraulic pressure applied via the hydraulic lash adjuster 52 and the oil passage 54 acts on the shoulder portion 38 of the coupling pin 36 in order to move the pin 36 against the force of the spring 40 into an unlocked position. In the unlocked position, the coupling surface 24 is free to move past the end of the pin 36, which allows the inner lever 12 to move up and down relative to the outer lever 14 about the pivot axle 28. In other words, in the unlocked position, the inner lever 12 is movable relative to the outer lever 14 in the direction(s) in which the levers were locked for movement in the locked position.

It should be understood that the disclosed embodiment in which hydraulic pressure moves the coupling pin 36 to an unlocked position and the spring 40 biases the coupling pin 36 to the locked position is exemplary. In alternative embodiments, hydraulic pressure from the oil passage 54 may move the coupling pin 36 to a locked position (e.g., in which the inner lever 12 and outer lever 14 are connected together for movement in at least one direction) and the spring 40 biases the coupling pin 36 to the unlocked position (e.g., in which the inner lever 12 is movable relative to the outer lever 14 in the at least one direction).

The configuration of the coupling device 34 thus allows for a switching operation to be performed by way of hydraulic fluid (e.g., oil) being selectively supplied to the bore 46. For example, a solenoid valve (not shown) may be selectively controlled to activate the coupling device 34 by supplying hydraulic fluid through the hydraulic lash adjuster 52, oil passage 54, and into the bore 46, thereby moving the pin 36 to the unlocked position. Similarly, a relief valve (not shown) may be selectively controlled to deactivate the coupling device 34 by decreasing the hydraulic pressure in the bore 46, thereby allowing the spring 40 to move the pin 36 back to the locked position. The switching operation allows the switchable roller finger follower 10 to switch between a lift mode and a no-lift mode.

In order for the switching operation to be effective, it should occur in a short amount of time. If the switching operation takes too long, the timing of the associated valve train may be adversely affected, reducing the efficiency of the engine. Air bubbles in the hydraulic flow path between the hydraulic lash adjuster 52 and the bore 46 may cause a slowing of the switching operation by effecting the speed with which the hydraulic pressure can be raised to a necessary level.

In order to remove these air bubbles, the disclosed switchable roller finger follower 10 includes a de-aeration feature which removes at least some of the air from the oil path. Consistent with disclosed embodiments, the switchable roller finger follower 10 includes a de-aeration flow path 56 which allows air and some oil to rise and enter the bore 46 through the oil passage 54 on one side of the bore 46 and exit the bore 46 through an opening 58 into the bore 46 formed on another side of the bore 46 at an upper location. In this way, air can move out of the oil passage 54, past the coupling pin 36, and exit through the opening 58. The opening 58 may be positioned anywhere in the end block 32. For example, the opening 58 may be positioned adjacent to the spring retainer 42 and snap ring 44 such that the spring retainer 42 and snap ring 44 are accessible via the opening 58.

Multiple embodiments of the coupling device 34 will be described with respect to the various figures. Each embodiment includes a different manner for forming the de-aeration flow path 56. In each of the embodiments, the coupling device 34 is configured such that the de-aeration flow path 56 is open when the coupling pin 36 is positioned in the locked position and blocked when the coupling pin is in the unlocked position. In the locked position, the hydraulic pressure in the bore 46 is relative low (e.g., approximately 0.2-0.3 Bar) such that only a nominal amount of hydraulic fluid may leak out of the system, with a high percentage of the air exiting. The bore 46 being above the oil passage 56 helps to facilitate the exit of the air with only a small loss in hydraulic fluid.

Moreover, when the bore 46 is under high pressure (e.g., approximately 4-5 Bar) in the unlocked position, the hydraulic fluid is prevented from escaping the bore 46 through the de-aeration flow path 56. For example, movement of the coupling pin 36 from the locked position to the unlocked position causes the blocking of the de-aeration flow path 56 by disconnecting the de-aeration flow path 56. In other embodiments, a check valve may close at pressures above a threshold to block flow through the de-aeration flow path 56.

In the disclosed embodiments, the de-aeration flow path 56 may be defined, at least in part, by the components in the vicinity of the bore 46. For example, the de-aeration flow path 56 may be defined at least in part by one or more of the end block 32, the coupling pin 36, the spring 40, the spring retainer 42, and the snap ring 44. For example, the coupling pin 36 may include a cutout feature 60 which at least in part defines the de-aeration flow path 56. Moreover, the spring retainer 42 may include a hole 62 which at least in part defines the de-aeration flow path 56. These and additional or alternative features of the de-aeration flow path 56 will be described in more detail below in relation to the illustrated embodiments.

Figure 4:
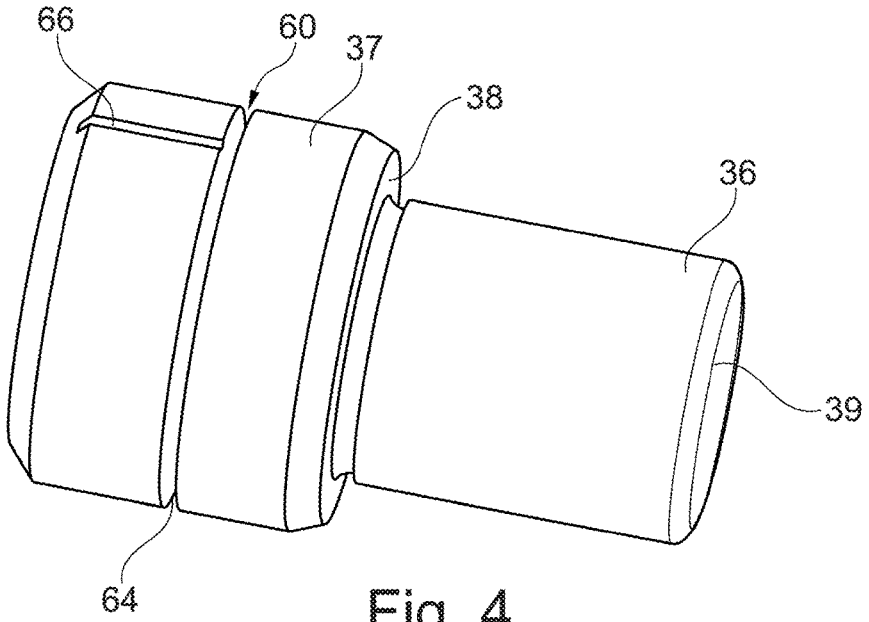
FIG. 4 is a perspective view of a coupling pin of the coupling device of FIGS. 1-3.

FIGS. 1-4 illustrate the switchable roller finger follower 10 according to a first embodiment, including the coupling device 34 and de-aeration flow path 56. FIG. 4 illustrates the coupling pin 36 in more detail, including the cutout feature 60. In the embodiment of FIG. 4, the cutout feature 60 includes a radial groove 64 formed in the head portion 37 of the coupling pin 36. The cutout portion 60 may also include an axial groove 66 formed in the head portion 37, the axial groove 66 fluidly connected to the radial groove 64. The radial groove 64 and axial groove 66 create a flow path for air to move past the coupling pin 36 when the coupling pin 36 is in the bore 46.

As shown in FIGS. 1-3, the de-aeration flow path 56 may be further defined by a groove 68 formed in the end block 32 adjacent the bore 46. The coupling pin 36 and bore 46 are formed such that the groove 68 and radial groove 64 are fluidly connected when the coupling pin 36 is in the locked position (as shown in FIGS. 1 and 2) and disconnected when the coupling pin 36 is in the unlocked position (as shown in FIG. 3). In the locked position, the de-aeration flow path 56 is open to fluidly connect the oil passage 54 to the opening 58, thereby allowing air to escape from the oil passage 54, the hydraulic lash adjuster 52, and any associated oil galleries which may supply hydraulic fluid thereto. In the unlocked position, the head portion 37 of the coupling pin 36 blocks the de-aeration flow path 56, thereby preventing an excessive amount of oil from escaping when the hydraulic pressure is raised to move the coupling pin 36 to the unlocked position.

Figure 5:
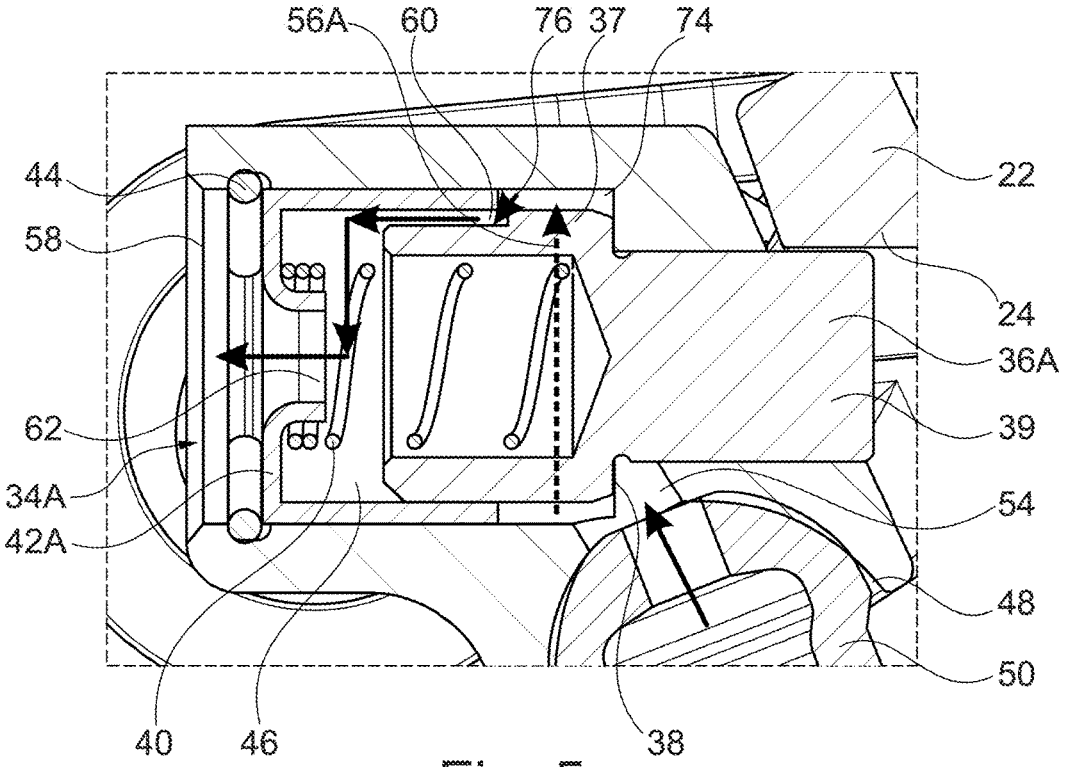
FIG. 5 is an enlarged cross-sectional view of a coupling device of a switchable roller finger follower in a locked position, according to a second embodiment.
Figure 6:
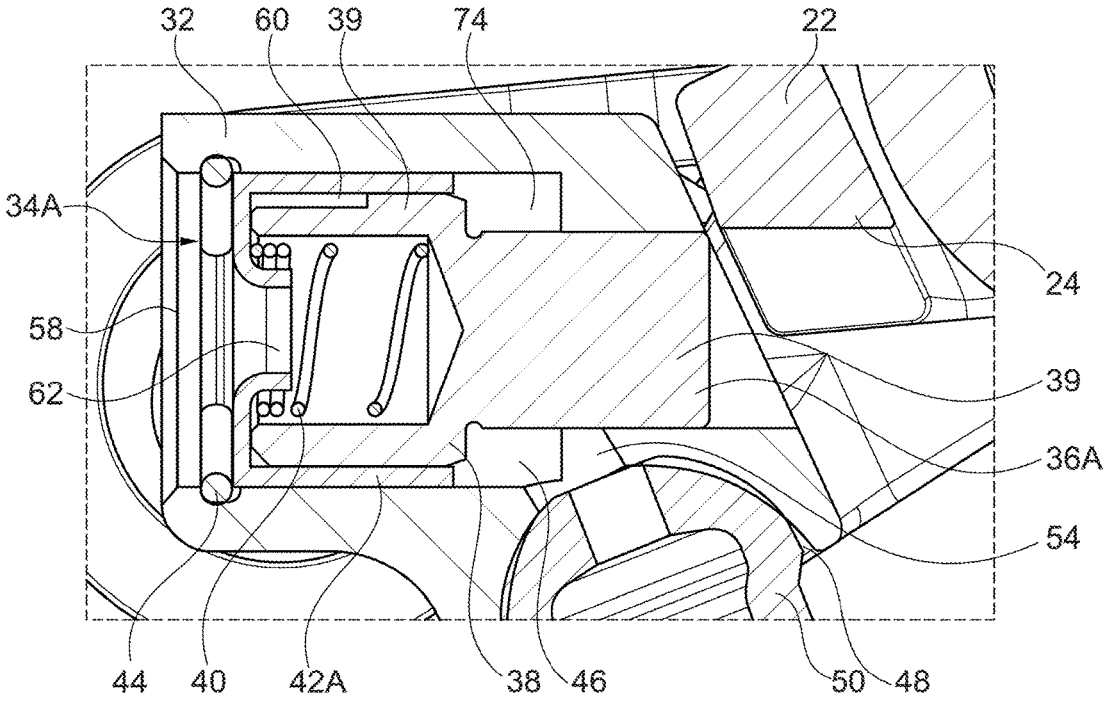
FIG. 6 is an enlarged cross-sectional view of the coupling device of FIG. 5 in an unlocked position.
Figure 7:
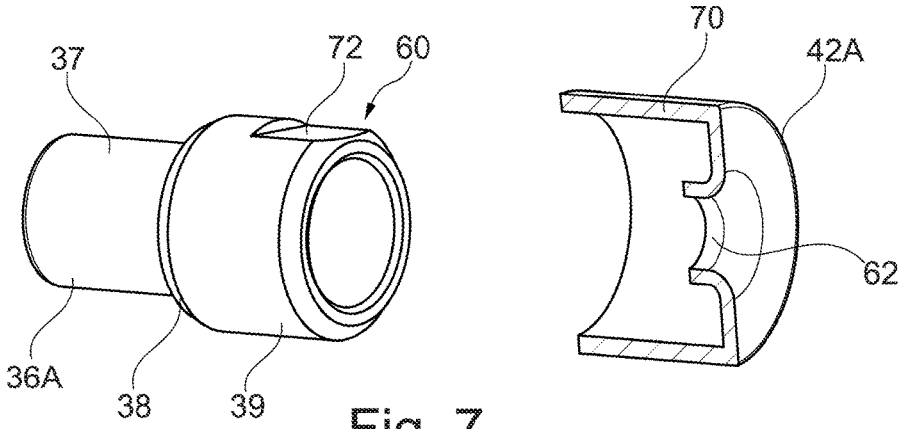
FIG. 7 is a perspective view of a coupling pin of the coupling device of FIGS. 5-6.

FIGS. 5-7 illustrate a switchable roller finger follower 10A according to a second embodiment, including a coupling device 34A having a coupling pin 36A and spring retainer 42A which at least in part define a de-aeration flow path 56A. FIG. 5 illustrates the coupling pin 36A in the locked position. FIG. 6 illustrates the coupling pin 36A in the unlocked position. FIG. 7 further illustrates the coupling pin 36A, including the respective cutout feature 60, and the spring retainer 42A in more detail.

As shown in FIGS. 5-7, the coupling pin 36A is formed to fit into the spring retainer 42A. For example, the spring retainer 42A includes a perimeter wall 70 defining a space for receiving the head portion 37 of the coupling pin 36. The cutout feature 60 includes a flat profile 72 formed in the head portion 37 of the coupling pin 38. The flat profile 72 creates a flow space between the head portion 37 and the perimeter wall 70. Alternatively, the cutout portion 60 may be an axial groove similar to the axial groove 66 depicted in FIG. 4.

As shown in FIGS. 5 and 6, the smaller head portion 37 of the coupling pin 36 creates a space 74 in the bore 46 which is connected to the oil passage 54. Air and hydraulic may freely enter this space 74 from the oil passage 54. As shown in FIG. 5, when the coupling pin 36A is in the locked position, the de-aeration flow path 56A includes a gap 76 formed between an end of the perimeter wall 70 of the spring retainer 42A and the flat profile 72 in the head portion 37. In this way, air is permitted to flow from the space 74, into the spring retainer 42A, out of a hole 62A in the spring retainer 42A, and thereafter out of the bore 46 through the opening 58. As shown in FIG. 6, the gap 76 is closed by the head portion 37 of the coupling pin 36A when the coupling pin 36A moves to the unlocked position.

Figure 8:
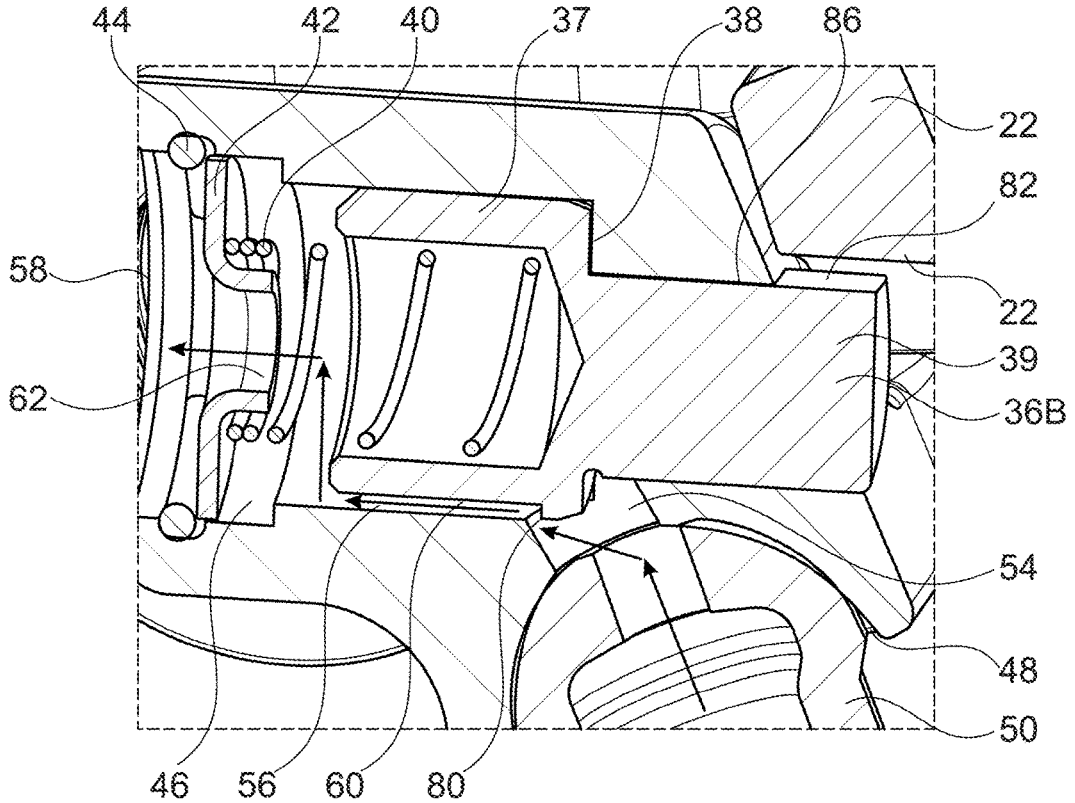
FIG. 8 is an enlarged cross-sectional view of a coupling device of a switchable roller finger follower in a locked position, according to a third embodiment.
Figure 9:
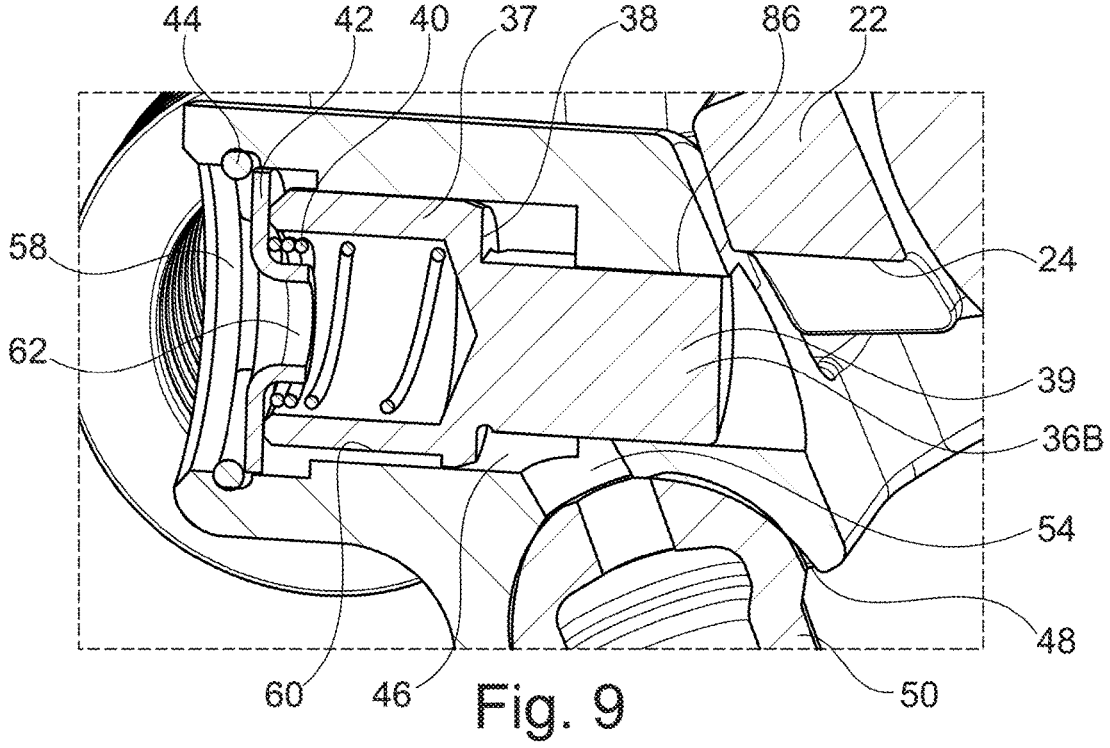
FIG. 9 is an enlarged cross-sectional view of the coupling device of FIG. 8 in an unlocked position.
Figure 10:
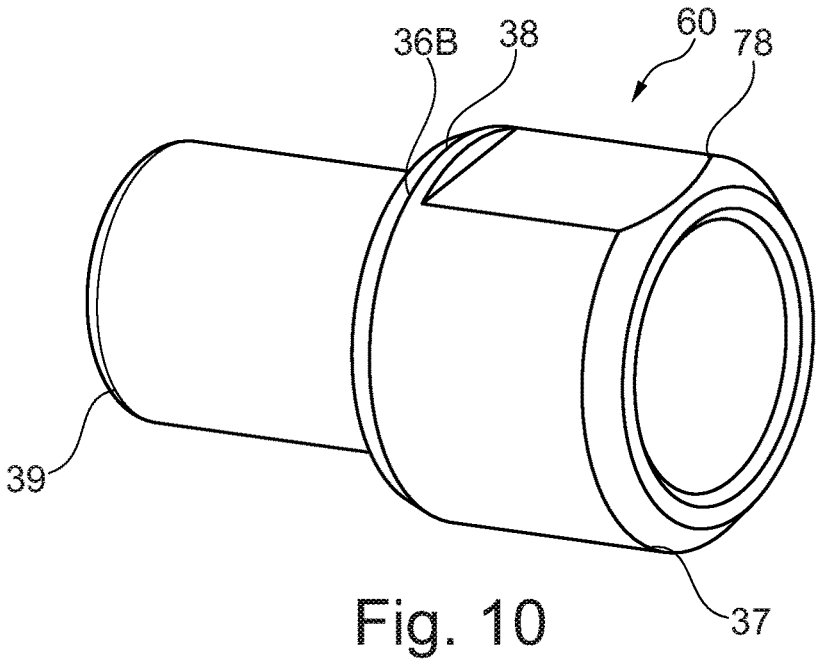
FIG. 10 is a perspective view of a coupling pin of the coupling device of FIGS. 8-9.
Figure 11:
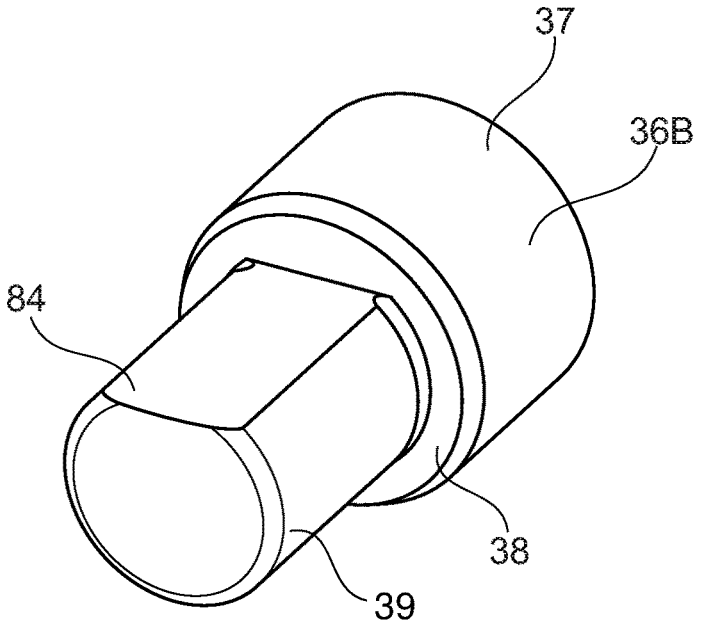
FIG. 11 is another perspective view of the coupling pin of FIGS. 8-10.

FIGS. 8-11 illustrate a switchable roller finger follower 10B according to a third embodiment, including a coupling device 34B having a coupling pin 36B which at least in part defines a de-aeration flow path 56B. FIG. 8 illustrates the coupling pin 36B in the locked position. FIG. 9 illustrates the coupling pin 36B in the unlocked position. FIGS. 10 and 11 further illustrate the coupling pin 36B, including the respective cutout feature 60 in more detail.

As shown in FIGS. 8-11, the cutout feature 60 of the coupling pin 36B includes a flat profile 78. The flat profile 78 creates a flow space between the head portion 37 and the outer surfaces of the bore 46. Alternatively the cutout portion 60 may be an axial groove similar to the axial groove 66 depicted in FIG. 4. The flat profile 78 is sized and positioned such that, with the coupling pin 36B in the locked position and the flat profile 78 positioned at the bottom of the head portion 37, a gap 80 is formed which allows air in the oil passage 54 to move past the coupling pin 36B via the space formed by the flat profile 78. The air follows further along the de-aeration flow path 56 through the hole 62 in the spring retainer 42 and exits through the opening 58. As shown in FIG. 9, the gap 80 is closed when the coupling pin 36B moves to the unlocked position.

Proper functioning of the de-aeration flow path in the embodiment illustrated in FIGS. 8-11 depends on the radial orientation of the coupling pin 36B relative to the end block 32. The gap 80 will not be formed unless the flat profile 78 is positioned at the bottom of the coupling pin 36B when the coupling pin 36B is in the bore 46. The coupling pin 36B further includes an alignment feature 82 configured to radially position the coupling pin relative to the end block 32. The alignment feature 82 may be, for example, a flat profile 84 formed on the shaft portion 39 of the coupling pin 36. The flat profile 84 is configured to mate with a corresponding flat profile 86 formed in a shaft-receiving portion of the end block 32. By matching up the flat profiles 84, 86, the flat profile 78 is radially positioned such that the gap 80 is created when the coupling pin 36B is in the locked position. While only depicted in relation to FIGS. 8-11, it should be understood that any embodiment consistent with this disclosure may include an alignment feature 82.

The disclosed embodiments are applicable to providing a de-aeration flow path for air to escape a hydraulic flow path. The disclosed embodiments are particularly applicable to a switchable roller finger follower, which relies on fast switching times. The reduction in air bubbles in the hydraulic fluid allows the switching operation to occur faster. The disclosed coupling devices for a switchable roller finger follower provide the integrated de-aeration flow path, thereby providing a simple solution that utilizes the existing components. Moreover, the disclosed configurations take advantage of the movement of the coupling pin of the coupling device such that the de-aeration flow path is disconnected and/or blocked when the coupling device is activated (e.g., the coupling pin is in the unlocked position), thereby inhibiting the flow of hydraulic fluid out of the system when the hydraulic pressure is high enough for the leakage to be significant.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

PARTS LIST

10. Switchable roller Finger Follower
12. Inner Lever
14. Outer Lever
16. Center Recess
18. Roller
20. Transverse Axle
22. Coupling Projection
24. Coupling Surface
26. Outer Arm
28. Pivot Axle
30. Lost Motion Spring
32. End Block
34. Coupling Device
34A. Coupling Device
34B. Coupling Device
36. Coupling Pin
36A. Coupling Pin
36B. Coupling Pin
37. Head Portion
38. Shoulder Portion
39. Shaft Portion
40. Spring
42. Spring Retainer
42A. Spring Retainer
44. Snap Ring
46. Bore
48. Socket
50. Support Head
52. Hydraulic Lash Adjuster
54. Oil Passage
56. De-Aeration Flow Path
56A. De-Aeration Flow Path
56B. De-Aeration Flow Path
58. Opening
60. Cutout Feature
62. Hole
64. Radial Groove
66. Axial Groove
68. Groove
70. Perimeter Wall
72. Flat Profile
74. Space
76. Gap
78. Flat Profile
80. Gap
82. Alignment Feature
84. Flat Profile
86. Flat Profile

What is claimed is:

1. A switchable roller finger follower, comprising:

an inner lever;

an outer lever pivotably mounted to the inner lever by a pivot axle, an end block on one of the inner lever or the outer lever, the end block comprising a bore, an opening into the bore on one side of the bore and an oil passage connected to the bore on another side of the bore; and a coupling device, comprising:

a coupling pin configured to move between a locked position in which the inner lever and the outer lever are connected together for movement in at least one direction and an unlocked position in which the inner lever is movable relative to the outer lever in the at least one direction, pressure from a hydraulic fluid from the oil passage moves the coupling pin into one of the locked or the unlocked position; and a spring configured to bias the coupling pin in the other of the locked position or the unlocked position;

a de-aeration flow path is formed between the oil passage and the opening for allowing air to move out of the oil passage, past the coupling pin, and exit through the opening, and the de-aeration flow path is open when the coupling pin is in one of the locked position or the unlocked position and blocked when the coupling pin is in the other of the locked position or the unlocked position.

2. The switchable roller finger follower of claim 1, wherein the de-aeration flow path is defined at least in part by a cutout feature formed in the coupling pin.

3. The switchable roller finger follower of claim 2, wherein the cutout feature includes a radial groove formed in a head portion of the coupling pin.

4. The switchable roller finger follower of claim 3, wherein the cutout feature further includes an axial groove formed in the head portion of the coupling pin, the axial groove extending from the radial groove toward the opening.

5. The switchable roller finger follower of claim 2, wherein the cutout feature includes a flat profile or an axial groove formed in a head portion of the coupling pin.

6. The switchable roller finger follower of claim 5, wherein the coupling pin further comprises an alignment feature configured to radially position the coupling pin relative to the end block.

7. The switchable roller finger follower of claim 6, wherein the alignment feature is a flat profile formed on a shaft portion of the coupling pin and configured to mate with a flat profile formed on a shaft-receiving portion of the end block.

8. The switchable roller finger follower of claim 2, wherein movement of the coupling pin from one of the locked position or the unlocked position to the other of the locked position or the unlocked position disconnects the de-aeration flow path.

9. The switchable roller finger follower of claim 8, wherein the de-aeration flow path is further defined by a groove formed in the end block, the groove in the end block connecting the oil passage to a groove formed in a head portion of the coupling pin when the coupling pin is in the locked position and being disconnected from the groove formed in the head portion when the coupling pin is in the unlocked position.

10. The switchable roller finger follower of claim 9, wherein the cutout feature further includes an axial groove formed in the head portion of the coupling pin, the axial groove extending from the radial groove toward the opening.

11. The switchable roller finger follower of claim 8, wherein:

the coupling device further includes a spring retainer, the spring retainer includes a perimeter wall defining a space for receiving a head portion of the coupling pin, the de-aeration flow path includes a gap formed between an end of the perimeter wall and the cutout feature of the coupling pin, and the gap is closed by the head portion of the coupling pin when the coupling pin moves to the unlocked position.

12. The switchable roller finger follower of claim 11, wherein the cutout feature includes a flat profile formed in a head portion of the coupling pin.

13. The switchable roller finger follower of claim 1, wherein the end block includes a socket for receiving a support head of a hydraulic lash adjuster.

14. The switchable roller finger follower of claim 1, wherein the coupling device further includes a spring retainer and a snap ring.

15. The switchable roller finger follower of claim 14, wherein the de-aeration flow path is defined at least in part by a hole formed in the spring retainer.

16. A switchable roller finger follower, comprising:

an inner lever;

an outer lever pivotably mounted to the inner lever by a pivot axle, an end block on one of the inner lever or outer lever, the end block comprising a bore, an opening into the bore on one side of the bore and an oil passage connected to the bore on another side of the bore; and a coupling device, comprising:

a coupling pin configured to move between a locked position in which the inner lever and the outer lever are connected together for movement in at least one direction and an unlocked position in which the inner lever is movable relative to the outer lever in the at least one direction, pressure from a hydraulic fluid from the oil passage moves the coupling pin into one of the locked or the unlocked position;

a spring configured to bias the coupling pin in the other of the locked position or the unlocked position; and a spring retainer configured to retain an end of the spring, a de-aeration flow path provided between the oil passage and the opening permits air to move out of the oil passage, past the coupling pin, and exit through the opening, the de-aeration flow path is formed at least in part by a cutout feature formed in the coupling pin and a hole in the spring retainer, and movement of the coupling pin from one of the locked position or the unlocked position to the other of the locked position or the unlocked position disconnects the de-aeration flow path.

17. The switchable roller finger follower of claim 16, further comprising a snap ring which positions the spring retainer in the bore.

18. The switchable roller finger follower of claim 17, wherein the snap ring and the spring retainer are accessible via the opening.

19. The switchable roller finger follower of claim 16, wherein the cutout feature includes a radial groove formed in a head portion of the coupling pin.

20. The switchable roller finger follower of claim 16, wherein the cutout feature includes a flat profile formed in a head portion of the coupling pin.

* * * * *